US005833515A

United States Patent [19]

Shahbazian et al.

[11] Patent Number: 5,833,515

[45] Date of Patent: Nov. 10, 1998

[54] INFLATABLE BREAST PADS FOR A BRASSIERIE

[76] Inventors: Khachik Shahbazian; Harout Ajaryan, both of 532 Riverdale Dr., Glendale, Calif. 91204

[21] Appl. No.: 916,502

[22] Filed: Aug. 22, 1997

[51] Int. Cl.[6] ..... A41C 3/12; A41C 3/14; A41C 3/10; A41D 27/00

[52] U.S. Cl. ..... 450/38; 2/267; 450/57; 450/92; 450/93

[58] Field of Search ..... 2/73, 67, 267, 2/268, DIG. 3, DIG. 10; 450/38, 53, 54, 55, 56, 57, 92, 93; 36/29; 137/223; 417/374, 437, 472, 480, 479

[56] References Cited

U.S. PATENT DOCUMENTS

| | | | |
|---|---|---|---|
| 2,598,003 | 5/1952 | Leo et al. | 450/38 |
| 2,864,372 | 12/1958 | Buckley | 450/38 |
| 2,864,373 | 12/1958 | Buckley | 450/38 |
| 5,329,640 | 7/1994 | Hourigan | 2/239 |
| 5,347,656 | 9/1994 | Fabritz | 450/38 |

*Primary Examiner*—Jeanette E. Chapman

[57] ABSTRACT

Inflatable breast pads for use with a brasserie are provided including a pair of inflatable bladders each situated within an associated one of the cups of a brassiere. Further included is an inflation mechanism for inflating the inflatable bladders.

1 Claim, 2 Drawing Sheets

INFLATABLE BREAST PADS FOR A BRASSIERIE

BACKGROUND OF THE INVENTION

1. Field of the Invention

The present invention relates to inflatable breast pads for a brasserie and more particularly pertains to increasing the apparent breast size of a user.

2. Description of the Prior Art

The use of breast augmentation devices is known in the prior art. More specifically, breast augmentation devices heretofore devised and utilized for the purpose of implanting padding within cups of a brassiere are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,221,227; U.S. Pat. No. 5,303,425; U.S. Pat. Des. No. 355,294; U.S. Pat. No. 4,828,559; U.S. Pat. No. 5,329,640; and U.S. Pat. No. 5,113,530.

In this respect, the inflatable breast pads for a brasserie according to the present invention substantially departs from the conventional concepts and designs of the prior art, and in so doing provides an apparatus primarily developed for the purpose of increasing the apparent breast size of a user.

Therefore, it can be appreciated that there exists a continuing need for a new and improved inflatable breast pads for a brasserie which can be used for increasing the apparent breast size of a user. In this regard, the present invention substantially fulfills this need.

SUMMARY OF THE INVENTION

In view of the foregoing disadvantages inherent in the known types of breast augmentation devices now present in the prior art, the present invention provides an improved inflatable breast pads for a brasserie. As such, the general purpose of the present invention, which will be described subsequently in greater detail, is to provide a new and improved inflatable breast pads for a brasserie which has all the advantages of the prior art and none of the disadvantages.

To attain this, the present invention essentially comprises a brassiere having a pair of opposed cups coupled by an intermediate connecting member. Note FIG. 1. For reasons that will become apparent later, the cups are preferably formed of an elastic flexible material. The brassiere further includes a torso strap coupled to sides of the cups opposite the connecting member. A pair of shoulder straps are coupled between an upper extent of each cup and the torso strap. As shown in FIG. 2, a pair of inflatable bladders are each situated within an associated one of the cups of the brassiere. The inflatable bladders have a dome shaped configuration with a circular periphery. Such periphery is stitchedly coupled along a perimeter of an associated one of the cups of the brassiere, a shown in FIG. 3. Finally, an inflation assembly is provided including a hemispherical hollow pump having a planar surface centrally mounted on the connecting member of the brassiere. The inflation assembly further includes a pair of tubes each having a first end connected to a side of the pump adjacent the planar surface thereof. A second end of each tube is connected to an associated one of the inflatable bladders. As shown in FIG. 5, a one-way valve is integrally formed in each of the tubes adjacent the first end thereof. Lastly, an aperture is formed in an apex of the pump. By this structure, a finger may be repeatedly placed over the aperture and the pump depressed for inflating the bladders.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved inflatable breast pads for a brasserie which has all the advantages of the prior art breast augmentation devices and none of the disadvantages.

It is another object of the present invention to provide a new and improved inflatable breast pads for a brasserie which may be easily and efficiently manufactured and marketed.

It is a further object of the present invention to provide a new and improved inflatable breast pads for a brasserie which is of a durable and reliable construction.

An even further object of the present invention is to provide a new and improved inflatable breast pads for a brasserie which is susceptible of a low cost of manufacture with regard to both materials and labor, and which accordingly is then susceptible of low prices of sale to the consuming public, thereby making such inflatable breast pads for a brasserie economically available to the buying public.

Still yet another object of the present invention is to provide a new and improved inflatable breast pads for a brasserie which provides in the apparatuses and methods of the prior art some of the advantages thereof, while simultaneously overcoming some of the disadvantages normally associated therewith.

Still another object of the present invention is to increase the apparent breast size of a user.

Lastly, it is an object of the present invention to provide new and improved inflatable breast pads for use with a brasserie including a pair of inflatable bladders each situated within an associated one of the cups of a brassiere. Further included is an inflation mechanism for inflating the inflatable bladders.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
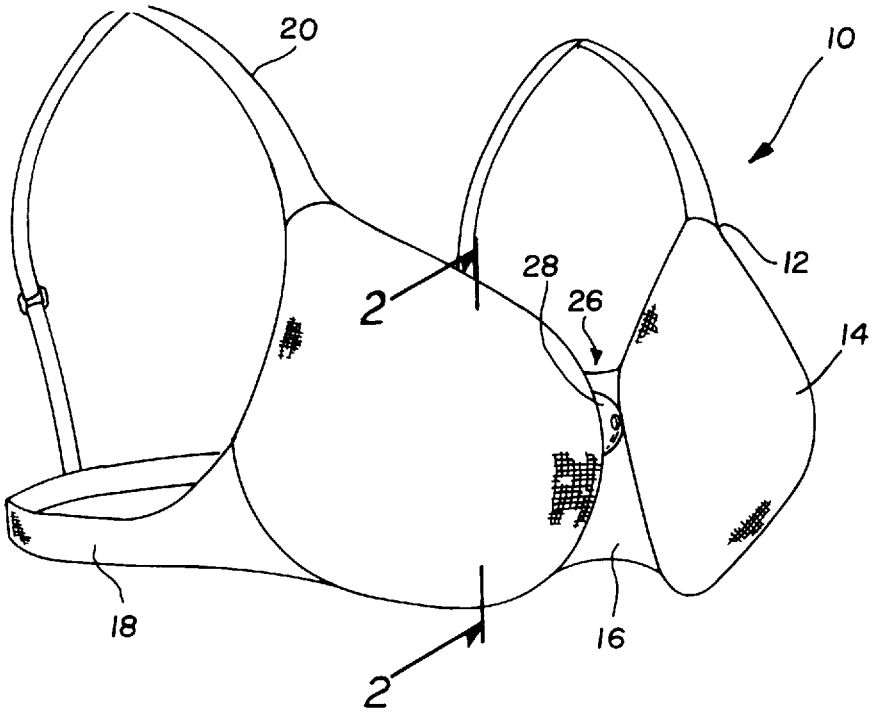
FIG. 1 is a perspective illustration of the preferred embodiment of the inflatable breast pads for a brasserie constructed in accordance with the principles of the present invention.

With reference now to the drawings, and in particular to FIG. 1 thereof, a new and improved inflatable breast pads for a brasserie embodying the principles and concepts of the present invention and generally designated by the reference numeral 10 will be described.

The present invention, the new and improved inflatable breast pads for a brasserie, is comprised of a plurality of components. Such components in their broadest context include a brassiere, a pair of inflatable bladders, and an inflation assembly. Such components are individually configured and correlated with respect to each other so as to attain the desired objective.

More specifically, it will be noted that the system 10 of the present invention includes a brassiere 12 having a pair of opposed cups 14 coupled by an intermediate connecting member 16. Note FIG. 1. For reasons that will become apparent later, the cups and interconnection member are preferably formed of an elastic flexible material. The brassiere further includes a torso strap 18 coupled to sides of the cups opposite the connecting member. A pair of shoulder straps 20 are coupled between an upper extent of each cup and the torso strap.

Figure 2:
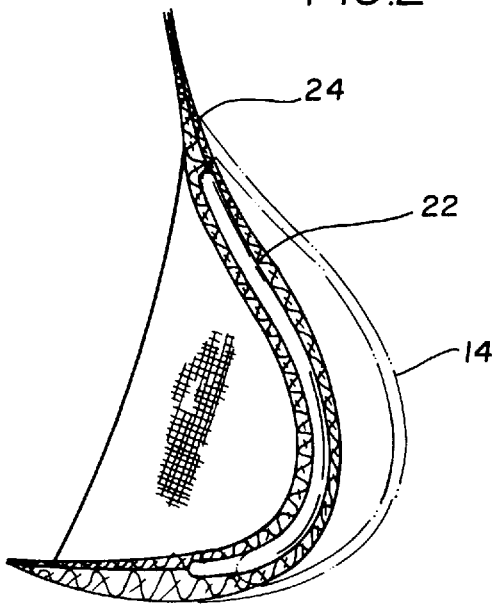
FIG. 2 is a side cross-sectional view of one of the inflatable bladders taken along line 2—2 shown in FIG. 1.
Figure 3:
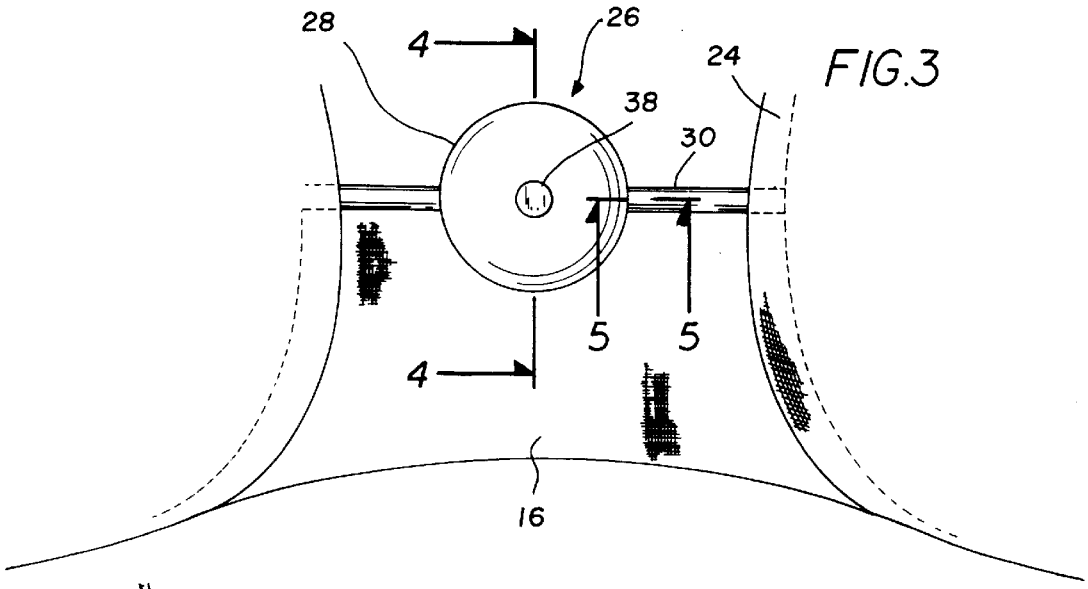
FIG. 3 is a front view of the pump inflation assembly of the present invention.
Figure 4:
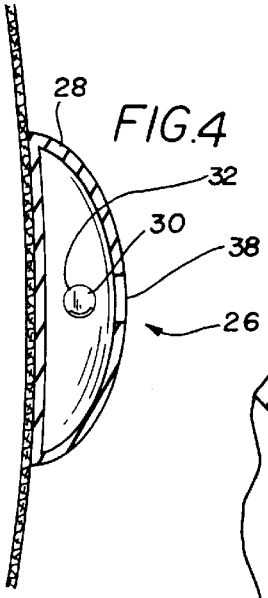
FIG. 4 is a cross-sectional view of the pump taken along line 4–4 shown in FIG. 3.

As shown in FIG. 2, a pair of inflatable bladders 22 are each situated within an associated one of the cups of the brassiere. The inflatable bladders have a dome shaped configuration with a circular periphery 24. Such periphery is stitchedly coupled along a perimeter of an associated one of the cups of the brassiere, a shown in FIG. 3. It should be noted that upon the inflation of the bladders while the brassier is worn, a front surface thereof is adapted to protrude outwardly thereby stretching the material from which the cup is constructed. This gives the appearance of larger breasts.

To ensure that no discomfort is afforded to the user, it is preferred that the front surface of each bladder exhibits a greater amount of elasticity as opposed to a rear surface thereof. As such, the rear surface maintains its cup-like shape. To accomplish this, different materials may be employed in the making of the rear and front face of each bladder or, in the alternative, the thickness of each face may be different.

Finally, an inflation assembly 26 is provided including a hemispherical hollow pump 28 having a planar surface centrally mounted on the connecting member of the brassiere by way of an adhesive. The inflation assembly further includes a pair of tubes 30 each having a first end connected to a side of the pump adjacent the planar surface thereof. A second end of each tube is connected to an associated one of the inflatable bladders.

Figure 5:
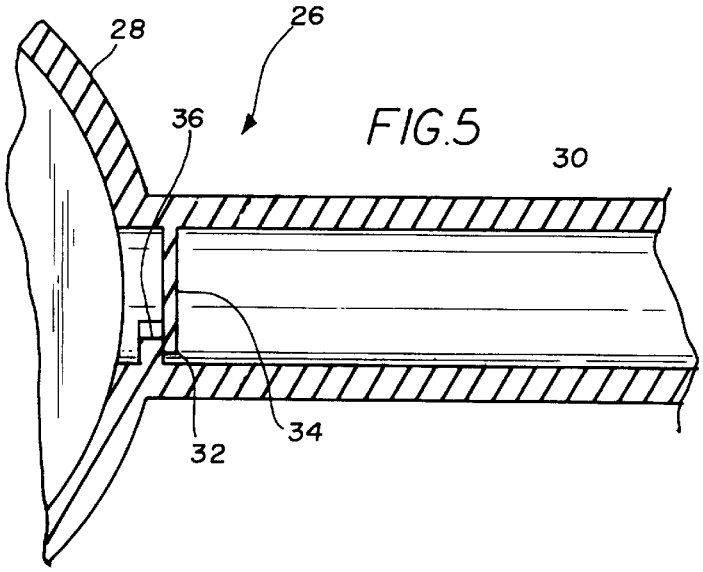
FIG. 5 is a cross-sectional view of the pump and associated tubes and valves taken along line 5–5 shown in FIG. 3.

As shown in FIG. 5, a one-way valve 32 is integrally formed in each of the tubes adjacent the first end thereof. Such one way valves each comprises of a circular flap 34 having a portion of the periphery thereof integrally coupled to an interior surface of the respective tube. Further, a lip 36 is positioned adjacent an interior surface of the flap to ensure that the flap may be only biased outwardly thereby only allowing air to flow to the bladders. Lastly, an aperture 38 is formed in an apex of the pump. By this structure, a finger may be repeatedly placed over the aperture and the pump depressed for inflating the bladders.

For releasing the pressure, a top and a bottom of the hemispherical pump may be squeezed which in turn pinches the tubes. This action bends the flaps allowing the release of air. It should be noted that, in the alternative, an additional valve may be positioned at the second end of each of the tubes to accomplish the same. In alternate embodiments, the concepts of the present invention may be utilized to construct devices for enlarging the genital and buttocks areas of an individual.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A inflatable breast pads for a brasserie comprising, in combination:

a brassiere having a pair of opposed cups coupled by an intermediate connecting member, the cups being formed of an elastic flexible material, the brassiere further including a torso strap coupled to sides of the cups opposite the connecting member and a pair of shoulder straps coupled between an upper extent of each cup and the torso strap;

a pair of inflatable bladders each situated within an associated one of the cups of the brassiere, a front wall of each bladder having an elasticity which is greater than that of a rear wall thereof, the inflatable bladder having a dome shaped configuration with a circular periphery stitchedly coupled along a perimeter of an associated one of the cups of the brassiere, wherein upon the inflation of the bladders, the front walls thereof protrude outwardly thereby stretching the material from which the cups are constructed; and an inflation assembly including a hemispherical hollow pump having a planar surface centrally mounted on the connecting member of the brassiere, the inflation assembly further including a pair of tubes each having a first end connected to a side of the pump adjacent the planar surface thereof and a second end connected to an associated one of the inflatable bladders, a one-way valve integrally formed in each of the tubes adjacent the first end thereof, and an aperture formed in an apex of the pump, whereby a finger may be repeatedly placed over the aperture and the pump depressed for inflating the bladders.

* * * * *